US006349923B1

(12) United States Patent
Goodell

(10) Patent No.: US 6,349,923 B1
(45) Date of Patent: Feb. 26, 2002

(54) STAPLE REMOVER

(76) Inventor: John L. Goodell, 617 Washington St., Jamestown, NY (US) 14701

( * ) Notice: Subject to any disclaimer, the term of this patent is extended or adjusted under 35 U.S.C. 154(b) by 0 days.

(21) Appl. No.: 09/579,091

(22) Filed: May 25, 2000

(51) Int. Cl.[7] ..... B25C 11/00
(52) U.S. Cl. ..... 254/28
(58) Field of Search ..... 254/28, 21, 22

(56) References Cited

U.S. PATENT DOCUMENTS

| | | | | |
|---|---|---|---|---|
| 2,431,922 A | 12/1947 | Curtiss | 254/28 |
| D157,995 S | 4/1950 | Pankonin | D74/1 |
| 3,311,346 A | 3/1967 | Almond, Jr. | 254/28 |
| 3,484,080 A | 12/1969 | Tolliver | 254/28 |
| 3,630,486 A | 12/1971 | Foitle | 254/28 |
| 4,903,945 A | 2/1990 | Wang | 254/28 |
| 4,921,216 A | 5/1990 | Krulich | 254/28 |
| 4,944,491 A | 7/1990 | Kirk | 254/28 |
| 5,284,322 A | 2/1994 | Clark | 254/28 |
| 5,513,833 A | 5/1996 | Kirk | 254/28 |
| 5,657,965 A | 8/1997 | Arias | 254/28 |

*Primary Examiner*—Robert C. Watson
(74) *Attorney, Agent, or Firm*—Hodgson Russ LLP

(57) ABSTRACT

A staple remover of the type having opposed cam surfaces, with each jaw having a pair of spaced apart sides with cam surfaces, for pulling a staple from an object and having a bridge member on one of the sides that disposed across the opening between the two sides to provide a stop along the cam surface and to provide a gripping surface for pulling staples.

13 Claims, 2 Drawing Sheets

STAPLE REMOVER

FIELD OF INVENTION

This invention relates to the art of staple pullers, and particularly to the art of hand-held staple pullers of the type having coacting cam surfaces that engage and remove a staple.

BACKGROUND OF THE INVENTION

A well-known staple remover comprises two pivotally attached parts that have cam surfaces at their respective ends. The device is held in the hand of a user, and the two parts are squeezed together by the user after the tips of the cams have been engaged with the staple. The bight of the staple is moved along the cam surfaces as the parts move toward each other to lift the staple and remove it from an object.

A common problem with this type of staple remover is that the staple is sometimes pulled from the object in an uneven manner (FIG. 6), which typically results in one leg remaining lodged in the object while the other leg is free. Another similar problem is that the staple is often broken by the action of the puller, leaving the part remaining in the object separate from the remainder of the staple. The flat parts of the known staple remover adjacent the cam surface do not permit secure gripping of the staple as this would interfere with the removal of subsequent staples.

Various arrangements have been proposed to allow the part of the staple that remains in the object to be grasped by the staple puller in a manner that does not rely on the action of the cam surfaces. One such arrangement is shown in U.S. Pat. No. 3,311,346 (Almond, Jr.). The staple remover according to this patent includes a block mounted in each of the channel-like parts of the staple remover such that the staple can be grasped between the blocks and pulled out. U.S. Pat. No. 4,921,216 (Krulich) shows a staple remover of the same general type wherein one of the cam surfaces has a notch for receiving the staple and for holding the staple securely by a force applied by the cam surface of the other part.

Arrangements similar to that of Krulich are shown by U.S. Pat. Nos. 858,257 (Breiding), 2,431,922 (Curtiss), and 4,869,464 (Davidson).

U.S. Pat. No. 4,944,491 (Kirk) teaches a staple puller wherein the cam surfaces are flanked by protrusions that expand the legs of the staple. U.S. Pat. No. 499,637 (Knight) shows yet another type of staple extractor.

U.S. Pat. No. 5,513,833 issued to Kirk discloses a rigid tongue member affixed to the base and between the sides of the lower jaw. The staple remover also includes a resilient member between the opposite jaws. The resilient member is designed to guide the staple so that it does not move up and over the opposite tongue-shaped piece. The problems with the design include the fact that the rigid member is not designed to trap the staple but is designed so as to tend to make the staple move up and over it against the resilient member. Also, it consists of two additions to the standard staple remover which adds to the complexity of manufacture. Another drawback to this arrangement is that the angled top section 76 appears to extend below the point of the jaw such that when one end of the staple exits the paper and the other end is caught, the free end would be capable of sliding over the angled section.

U.S. Pat. No. 4,903,945 issued to Wang discloses a centrally located engaging member that is located between the sides of one of the jaws and forms a slot with the sides of the jaws. The engaging member engages with the upper surface of the staple to thereby anchor the staple at a middle portion thereof for withdrawal of the staple ends from the paper. Wang does not disclose a flat surface forming a notch along the cam surface and providing a back-up method of gripping and removing an end of a staple if all else fails. Also, the central engaging member is disposed substantially parallel to the paper which in effect holds the center of the staple down against the paper when the curved jaws are encountering the greatest resistance trying to bend the legs of the staple to lift the staple away from the paper.

What is needed is an improved staple remover capable of removing staples such that both ends of the staple are removed and that has a gripping surface for removing staples that break or otherwise need to be pulled.

SUMMARY OF THE INVENTION

The present invention meets the above described need by providing a staple puller, of the type having two pivotally mounted parts and cam surfaces at the ends of each of the parts, with a bridge member connected to one of the narrower jaws of the device and extending across the opening between the jaws to form a stop and a pressure point for pulling staples.

In the preferred embodiment, the staple puller of the invention has a pair of spring-biased jaws with opposing cam surfaces. One set of jaws is spaced farther apart than the other pair such that the narrower jaws slide into the opening between the wider jaws. The sides of the narrower jaw are provided with a bridge member disposed thereon. The bridge member has a thickness approximately equal to the thickness of the jaw. The bridge member extends across the gap between the pair of jaw members of the narrower jaw such that it extends all the way across the opening and rises above the cam surface. The bridge member extends beyond the sides of the lower jaws such that it engages with the upper jaws. The bridge member forms a stop on the cam surface and provides a gripping surface formed between the top surface of the wider jaws and the top of the bridge member.

An engaging member is disposed between the sides of the jaws and is preferably supported from the bridge member. The engaging member extends between the sides of the narrower jaw and is preferably disposed at an angle proximate to the curved jaws such that a space is formed between the jaws and the underside of the engaging member. The space is provided to capture the staples at the beginning of the removal process.

DETAILED DESCRIPTION OF THE PREFERRED EMBODIMENT

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

Figure 1:
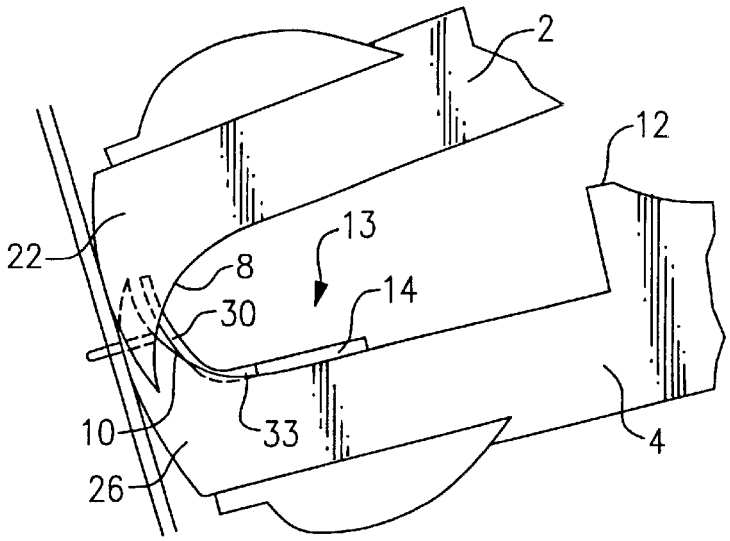
FIG. 1 is a side view of a staple remover according to the invention in an open position.
Figure 2:
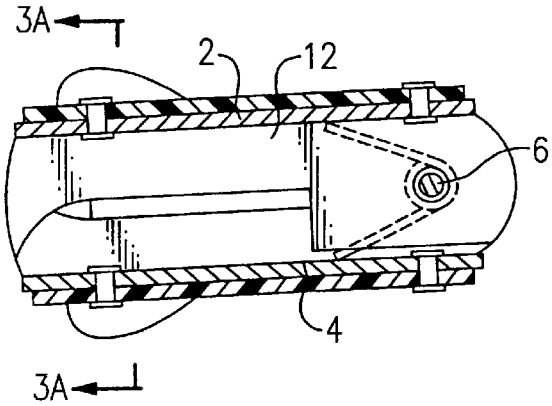
FIG. 2 is a longitudinal cross section of the staple remover of FIG. 1 in a closed position.

With reference to FIGS. 1–2, a preferred embodiment of a staple remover according to the invention comprises a first part 2 pivotally attached to a second part 4 at a pin 6. These parts are channel-shaped in transverse cross section, and part 4 is narrower than part 2 to allow it to fit between the sides of part 2. The channel-shaped parts form a pair of upper jaws 20, 22 and a pair of lower jaws 24, 26 respectively (shown in FIG. 3A). Part 2 includes a cam surface 8 at one end, and part 4 includes a cam surface 10 at an adjacent end. Cam surfaces 8 and 10 terminate in sharp tips to allow the cam surfaces to be forced under the bight of a staple and to pull the staple from an object in a manner known in the art.

A stop 12 is carried by part 4, the stop engages the bottom of part 2 when the parts are in the fully closed position. In known staple removers, the staple is pulled from the object only by the action of the cam surfaces, and the stop 12 is positioned to prevent significant clamping of the staple between the first and second parts.

In accordance with the invention, however, the part 4 is provided with a gripping surface 13. The gripping surface 13 is formed from a bridge member 14 that is disposed across the sides of part 4. The gripping surface has a width that is slightly greater than the width defined by the jaws 24, 26 carried by part 4. Each of the sides of part 4 are normally manufactured by stamping the metal parts. In the assembly of the staple remover, the bridge member 14 is disposed across the space between the two sides of part 4 such that it extends across the top of the jaws 24, 26 on the sides of part 4. The bridge member 14 extends beyond the sides of the jaws 24, 26 such that the bridge member is capable of engaging with the sides of the upper jaws 20, 22 when the staple remover is closed.

The bridge member 14 is preferably mounted on the lower jaws. The bridge member 14 may be attached to the lower jaws by mechanical fasteners, welding, or the like. During removal, the end of the staple spreads apart to the width of the wider jaw 2. The staple itself will stay with the engaging member 30, and if this part is in the wider jaw, the staple may stick on the outside edges of the jaw. If the bridge member 14 and engaging member 30 are mounted on the narrower jaw, the staple easily drops off when the jaws are opened. Accordingly, the preferred construction has the bridge member attached to the narrower jaws.

Figure 3A:
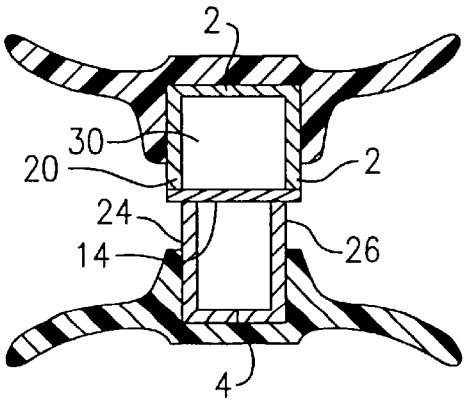
FIG. 3A is a cross section taken along line 3A—3A of FIG. 2.

Turning to FIG. 3A, the gripping surface is disposed on part 4 and extends across the top of the two sides of part 4. The gripping surface engages with the sides of part 2 when the jaws are closed against the force of the spring, as shown in FIG. 2.

Also, an engaging member 30 extends from the front of the bridge member 14 at an angle such that the engaging member 30 is proximate to the points of the narrower jaw (best shown in FIG. 1). As shown in FIG. 1, the engaging member 30 extends from the bridge member 14 and defines a space between the underneath of the engaging member 30 and the sides 24, 26 of the jaws. The space provides a passageway for the staple. The engaging member 30 engages with the staple to prevent the staple from straightening and assuming the position shown in FIG. 6 where one side of the staple forms a straight free end while the opposite side remains in the stack of materials.

Figure 3B:
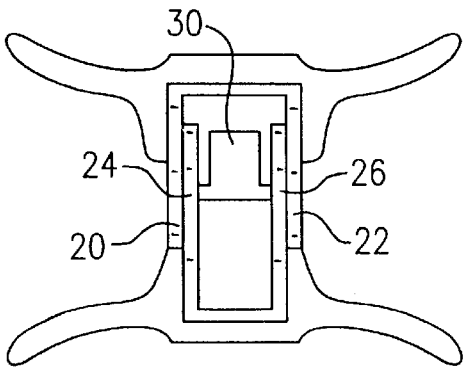
FIG. 3B is a front elevational view of the staple remover shown in FIG. 2.

Turning to FIG. 3B, the engaging member 30 extends upward from the bridge member 14 and fits between the sides 24, 26 of the narrower jaws carried by part 4.

The gripping surface created by the bridge member 14 mounted across the sides of the lower jaws 24, 26 performs several functions. First, it provides a stop 33 along the cam surface 8 which provides a leverage point for removing the staple. This stop 33 prevents one end of the staple from coming out without the other end. Once the staple reaches the stop 33, it is gripped on three sides by the edge of the stop 33 and by the upper 20, 22 and lower jaws 24, 26, respectively. This gripping on three sides is not achieved with a round center member. Also, the gripping surface provides for gripping staples that are not trapped by the stop. The gripping surface provides for gripping staples between the top of the bridge member 14 and the opposite pair of sides on part 2.

Figure 4A:
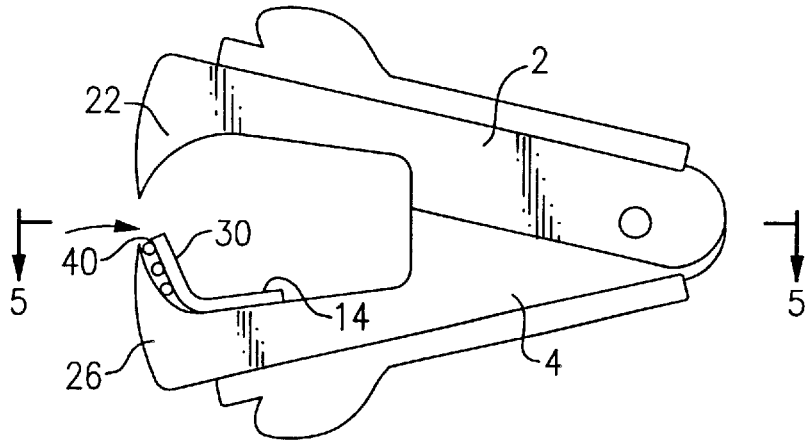
FIG. 4A is a side elevational view of the staple remover of the present invention illustrating a staple entering the device.
Figure 6:
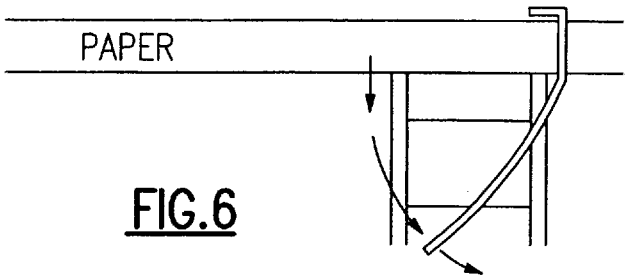
FIG. 6 is an elevational view of a staple being removed from a stack of paper.

In FIG. 4A, a staple 40 is shown as it enters the space between the lower jaws 24, 26 and the engaging member 30. The position of the engaging member 30 provides for engagement of the staple 40 at the beginning of the removal process to prevent one end of the staple 40 from exiting the paper and straightening as shown in FIG. 6. The staple 40 travels along the cam surface of the jaws until it is stopped by the convergence of the engaging member 30 and the jaws carried by part 4. As the jaws are tightened further, the staple is bent and forced into the three-sided trap against the bridge member 14 discussed above.

Figure 4B:
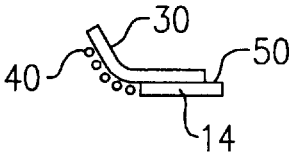
FIG. 4B is an enlarged view of an alternate embodiment of the bridge member and the engaging member of FIG. 4A.
Figure 5:
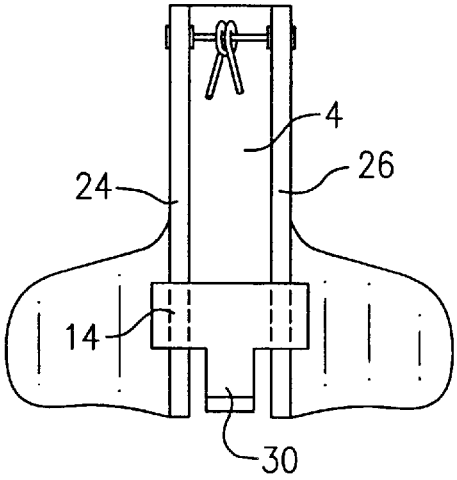
FIG. 5 is a cross-sectional view taken along lines 5—5 of FIG. 4A.

In FIG. 5, the lower jaws 24, 26 are shown with the bridge member mounted thereto. The bridge member 14 is wider than the jaws such that a portion of each side of the bridge member extends beyond the jaws 24, 26. The engaging member 30 extends from the side or top of the bridge member 14. If the engaging member 30 extends from the top 50 of the bridge member 14 (as shown in FIG. 4B), the position of the bridge member 14 above the cam surface 10 provides a mechanical stop to prevent the staple 40 from sliding any farther along the cam surface 10 of the second part 4 of the staple remover.

The present invention advantageously provides a mechanical stop for trapping the staple at right angles to the puller such that both sides of the staple must come out. Second, the gripping surface formed between the bridge member 14 and the sides 20, 22 on the opposite part 2 provides for gripping and pulling parts of the staple that have avoided the trap. Third, the engaging member 30 provides for capturing the staple 40 at the beginning of the removal process to prevent one end of the staple from exiting the paper and straightening out. The sharp tips of the jaws carried by the second part 4 slide underneath the bight of the staple to remove the staple. The engaging member 30 is disposed on the side of the staple opposite from the sharp tips thereby forming a slot for capturing the staple between the engaging member and the cam surfaces as it is removed from the paper. Accordingly, the staple is captured and pressure is applied to the bight of the staple from the engaging member such that both ends of the staple can be removed.

While the invention has been described in connection with certain preferred embodiments, it is not intended to limit the scope of the invention to the particular forms set forth, but, on the contrary, it is intended to cover such alternatives, modifications, and equivalents as may be included within the spirit and scope of the invention as defined by the appended claims.

What is claimed is:

1. A staple remover comprising:

a first part comprising a channel having opposed sides and a first cam surface at one end thereof for engaging a staple to be pulled, the opposed sides forming a first pair of spaced-apart jaws each terminating in sharp tips;

a second part comprising a channel having opposed sides and a second cam surface at one end thereof for engaging the staple to be pulled, the opposed sides forming a second pair of spaced-apart jaws each terminating in sharp tips;

a bridge member extending across the sides of the second part such that the bridge member extends beyond the sides a distance sufficient to engage with the sides of the first part when the first part and the second part are rotated toward each other;

an engaging member disposed between the sides of the second part such that an end of the engaging member is disposed adjacent to the tips of the first pair of spaced-apart jaw members; and, wherein said first and second parts are pivotally connected to each other and the width of said second part is less than that of said first part such that said opposed sides of said second part fit between said opposed sides of said first part.

2. The staple remover of claim 1, wherein the engaging member is attached to and extends from the bridge member.

3. The staple remover of claim 1, wherein the engaging member is attached to the second part.

4. The staple remover of claim 1, wherein the engaging member is attached to the top of the bridge member.

5. The staple remover of claim 1, wherein the engaging member is attached to the side of the bridge member.

6. The staple remover of claim 1, wherein the engaging member is disposed adjacent to the tips of the second pair of spaced-apart jaws such that a space is defined between the engaging member and the tips of the second pair of spaced-apart jaws.

7. The staple remover of claim 6, wherein the space between the engaging member and the tips of the second pair of spaced-apart jaws is disposed such that when a staple is removed the tips of the staple remover are disposed underneath the bight of the staple and the engaging member is disposed on an opposite side of the bight of the staple.

8. The staple remover of claim 1, wherein the engaging member is elongate.

9. The staple remover of claim 1, wherein the engaging member is arcuate.

10. The staple remover of claim 1, wherein the engaging member and the cam surface converge such that the surfaces are capable of trapping a staple therebetween.

11. The staple remover of claim 1, wherein the bridge member provides a mechanical stop for a staple traveling along the cam surface of the second part.

12. The staple remover of claim 1, wherein the engaging member extends beyond the tip of the spaced-apart sides of the second part.

13. A staple remover comprising:

a first part comprising a channel having opposed sides and a first cam surface at one end thereof for engaging a staple to be pulled, the opposed sides forming a first pair of spaced-apart jaws, each jaw terminating in a sharp tip;

a second part comprising a channel having opposed sides and a second cam surface at one end thereof for engaging the staple to be pulled, the opposed sides forming a second pair of spaced-apart jaws, each jaw terminating in a sharp tip;

a flat plate extending across the sides of the second part a distance sufficient to engage with the sides of the first part when the first part and the second part are rotated toward each other, the flat plate thereby capable of engaging the sides of the first part to provide a gripping surface therebetween for gripping staples for removal thereof;

an elongate, arcuate engaging member disposed between the sides of the second part such that an end of the engaging member is disposed adjacent to the tips of the first pair of spaced-apart jaw members, the end of the engaging member and the tips of the second pair of spaced-apart jaw members capable of receiving a staple such that the engaging member and the tips are disposed on opposite sides of the staple when the tips are placed underneath the bight of the staple for removal; and, wherein said first and second parts are pivotally connected to each other and the width of said second part is less than that of said first part such that said opposed sides of said second part fit between said opposed sides of said first part.

* * * * *